US005743139A

United States Patent [19]

Murata

[11] Patent Number: 5,743,139

[45] Date of Patent: Apr. 28, 1998

[54] STARTER WITH ALIGNMENT MEANS FOR PLANETARY GEARS

[75] Inventor: Mitsuhiro Murata, Anjo, Japan

[73] Assignee: Nippondenso Co., Ltd., Kariya, Japan

[21] Appl. No.: 648,824

[22] Filed: May 16, 1996

[30] Foreign Application Priority Data

May 18, 1995 [JP] Japan ..... 7-119430

[51] Int. Cl.[6] ..... F02N 15/02

[52] U.S. Cl. ..... 74/6 E; 74/7; 475/331; 475/346

[58] Field of Search ..... 475/331, 346; 74/6, 7 E

[56] References Cited

U.S. PATENT DOCUMENTS

| | | | |
|---|---|---|---|
| 5,189,921 | 3/1993 | Nagashima et al. | 74/7 E X |
| 5,199,309 | 4/1993 | Isozumi | 74/7 E |
| 5,471,890 | 12/1995 | Shiga et al. | 74/7 E |
| 5,473,956 | 12/1995 | Murata et al. | 74/7 E |
| 5,549,011 | 8/1996 | Shiga et al. | 74/7 E |
| 5,609,542 | 3/1997 | Kusumoto et al. | 475/331 |

FOREIGN PATENT DOCUMENTS 52-19528 7/1950 Japan .

*Primary Examiner*—Khoi Q. Ta

*Attorney, Agent, or Firm*—Cushman Darby & Cushman IP Group of Pillsbury Madison & Sutro LLP

[57] ABSTRACT

An internal gear of a planetary gear reduction mechanism and a clutch outer member of a one-way clutch are formed integrally with a cylindrical rotary member extending axially. The rear end of the cylindrical rotary member is formed as the internal gear, while the front end thereof is formed as the clutch outer member. A boss portion or a centering portion is formed integral with the cylindrical rotary member between the internal gear and the clutch outer member. The inner peripheral surface of the boss portion slidably engages the peripheral surface of a planet carrier or a flange formed at the rear end of a drive shaft. In this manner, the axis of the cylindrical rotary member aligns coaxially with the drive shaft.

9 Claims, 4 Drawing Sheets

STARTER WITH ALIGNMENT MEANS FOR PLANETARY GEARS

CROSS REFERENCE TO RELATED APPLICATION

The present application is based on and claims priority from Japanese Patent Applications No. Hei 7-119430, filed on May 18, 1995, the contents of which are incorporated herein by reference.

BACKGROUND OF THE INVENTION

1. Field of the Invention

The present invention relates to a starter for an engine having a planetary gear reduction mechanism.

2. Description of Related Art

A starter comprising a planetary gear reduction mechanism disclosed in Laid-Open Japanese Utility Model Publication No. 52-19528 is known. In the starter, a one-way clutch is interposed between the peripheral surface of an internal gear of the planetary gear reduction mechanism and the inner peripheral surface of a stationary casing which accommodates the planetary gear reduction mechanism. In the starter, when the pinion is driven at a high speed by the engine, a clutch inner member idles with respect to a clutch outer member to prevent the overrun of the starter motor, when clutch rollers are kept in contact with the peripheral surface of the clutch inner member. Thus, the clutch roller becomes worn.

In order to overcome the above-described problem, a clutch outer member 130, as shown in FIG. 5, integral with an internal gear 120 of the planetary gear reduction mechanism is arranged to be rotatable with respect to a clutch inner member 110 integral with a stationary center case 100. When the pinion 140 is rotated at a high speed by the ring gear 150 positioned at the engine side, the clutch outer member 130 together with the internal gear 120 idle with respect to the clutch inner member 110, thus preventing the overrun of the armature. Subjected to a centrifugal force generated by the rotation of the clutch outer member 130, a roller 160 interposed between the clutch inner member 110 and the clutch outer member 130 moves away from the peripheral surface of the clutch inner member 110, thus preventing abrasion of the roller 160.

When the starter is in operation, the internal gear 120 becomes eccentric radially due to backlash between the internal gear 120 and the planetary gears 170 and a play between the tooth edge of one of the internal gear 120 and planetary gear 170 and the tooth bottom of the other of those gears 120 and 170. Thus, the clutch outer member 130 spaced at a certain distance from the internal gear 120 may not uniformly press the roller 160 against the clutch inner member 110. In the worst case, the torque of the starter motor may not be transmitted from the clutch outer member 130 to the clutch inner member 110 through the roller 160.

When the rotor overruns, the internal gear 120 rotates idly together with the clutch outer member 130 at a high speed. Because the clutch outer member 130 is positioned in front of (left-hand side in FIG. 5) the internal gear 120 in the axial direction of a rotary member on which the clutch outer member 130 and the internal gear 120 are integrally formed, the front side of the rotary member does not balance well with the rear side thereof in the axial direction thereof. That is, the internal gear 120 inclines with respect to the axis of the rotary member, thus giving rise to gyrating. Moreover, the internal gear 120 abuts the cylindrical wall surface of the center case 100 with an offset load applied thereto. As a result, the internal gear 120 restrains the clutch roller 160, thereby inadvertently transmitting the rotation of the engine to the motor.

SUMMARY OF THE INVENTION

It is a first object of the present invention to provide a starter in which an internal gear is prevented from becoming eccentric.

It is a second object of the present invention to provide a starter in which the internal gear rotates idly and stably to prevent an armature from overrunning.

According to the present invention, when the torque of an armature shaft is transmitted to a drive shaft, a centering portion integral with a cylindrical rotary member aligns the axis of a cylindrical rotary member with that of a drive shaft. Accordingly, the cylindrical rotary member is aligned substantially coaxial with the drive shaft. Thus, an internal gear and a clutch outer member formed integrally with the cylindrical rotary member can rotate without becoming eccentric radially with respect to the drive shaft. Thus, the clutch outer member can press a roller against a clutch inner member uniformly, transmitting the torque of a starter motor to the drive shaft surely.

The inner peripheral surface of the centering portion of the cylindrical rotary member, preferably, slidably contacts the peripheral surface of the drive shaft, thus aligning the axis of the cylindrical rotary member with that of the drive shaft. That is, the axis of the cylindrical rotary member is allowed to align with that of the drive shaft without providing a particular bearing between the drive shaft and the centering portion. Accordingly, there is no increase in the number of parts or assembling processes in aligning the axis of the cylindrical rotary member with that of the drive shaft.

The axis of the cylindrical rotary member is aligned with that of the drive shaft by slidably engaging the inner peripheral surface of the centering portion with the peripheral surface of the flange portion projecting from the rear end of the drive shaft. In this case, the centering portion is formed on the cylindrical rotary member to engage the peripheral surface of the flange portion of the drive shaft. Thus, there is no need for axially increasing the length of the cylindrical rotary member to form the centering portion thereon.

The centering portion of the cylindrical rotary member is, preferably, located at a position intermediate between the internal gear and the clutch outer member in the axial direction thereof, so that the cylindrical rotary member can have a favorable balance between the internal gear side and the clutch outer member side in the axial direction thereof. Therefore, when the internal gear is rotated at a high speed by the engine, the cylindrical rotary member is prevented from gyrating. Consequently, the cylindrical rotary member rotates reliably even when the internal gear is rotated at a high speed.

Further, the centering portion of the cylindrical rotary member is located at a position intermediate between the internal gear and the clutch outer member in the axial direction thereof, and the inner peripheral surface of the centering portion contacts the peripheral surface of the drive shaft. Therefore, the centering portion partitions the cylindrical rotary member into the internal gear side and the clutch outer member side in the axial direction thereof, thus preventing foreign matters such as wear-caused powders from penetrating from one side into the other side and vice versa and also preventing different kinds of lubricating oils used at both sides from mixing each other. Accordingly, the centering portion functions as desired.

The thickness of the centering portion of the cylindrical rotary member in the radial direction thereof is, preferably, set to be greater than that of the internal gear and that of the clutch outer member in the radial direction thereof, so that the cylindrical rotary member can provide a suitable rigidity. Therefore, the cylindrical rotary member can be prevented from being deformed when a load is applied to the internal gear and the clutch outer member by the starter.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

(First Embodiment)

Figure 1:
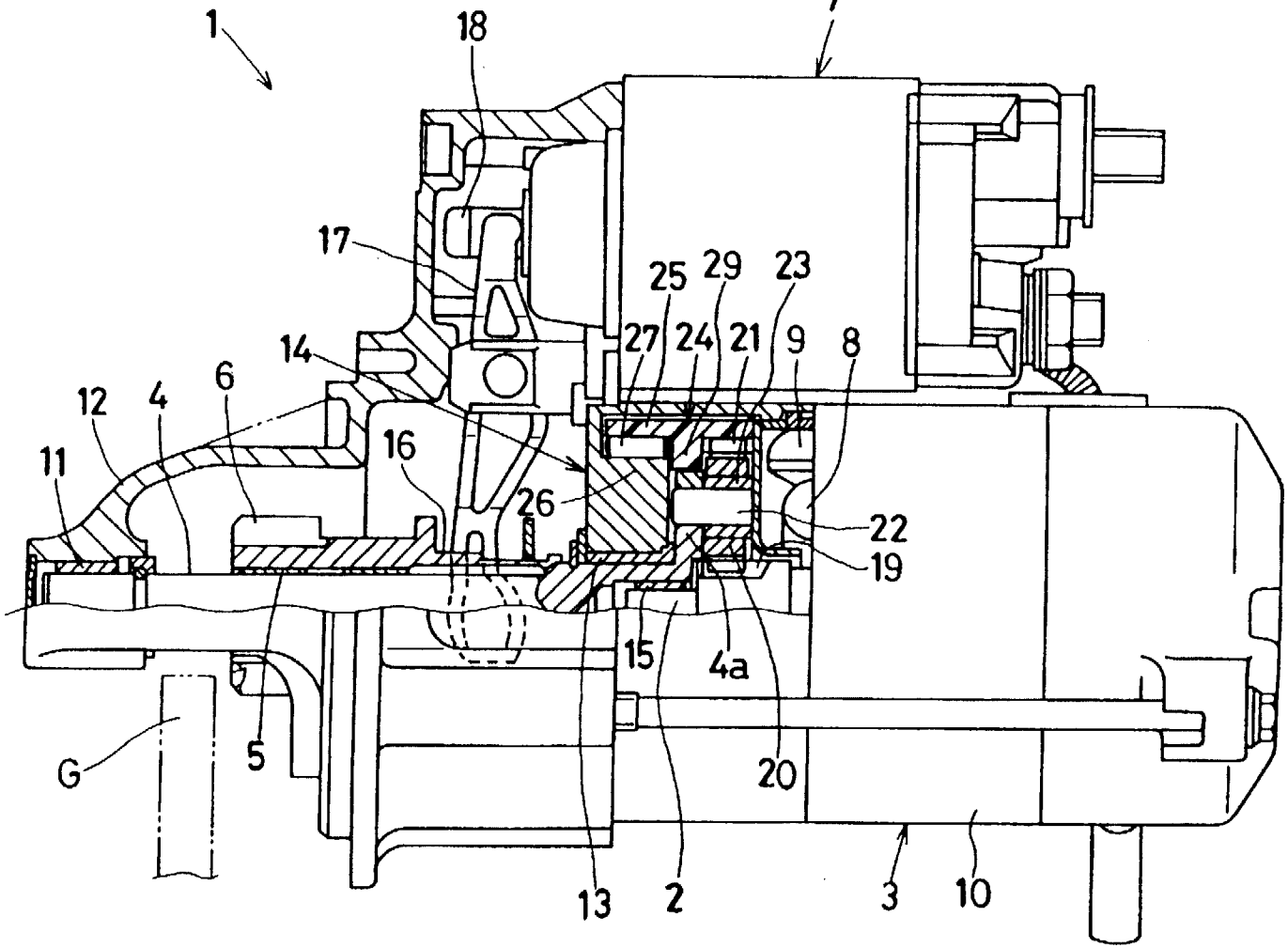
FIG. 1 is a cross-sectional view showing main portions of a starter according to a first embodiment.

A starter according to a first embodiment of the present invention will be described below with reference to drawings.

A first embodiment is described with reference to FIG. 1–FIG. 3B.

A starter 1 is composed of a starter motor 3 for generating a torque on a motor shaft 2 when it is energized with electric current, a drive shaft 4 positioned in front of the starter motor 3 and coaxial with the motor shaft 2, a torque-transmission unit for transmitting the torque of the starter motor 3 to the drive shaft 4, a pinion 6 in engagement with the peripheral surface of the drive shaft 4 through a bearing 5 and a magnet switch 7 for energizing the starter motor 3 with electric current and generating a force for pressing the pinion 6 forward.

The starter motor 3 has an armature rotor 8 carried by the motor shaft 2, a stationary magnetic pole 9 positioned around the armature rotor 8 and a cylindrical yoke 10 having the stationary magnetic pole 9 fixed to the inner peripheral surface thereof. When an unshown starter switch is turned on, an unshown contact incorporated in the magnet switch 7 is closed. As a result, the armature rotor 8 is energized with electric current and hence rotates.

The front end of the drive shaft 4 is rotatably supported by a front housing 12 at the front end thereof through a bearing 11, and the rear end of the drive shaft 4 is rotatably supported by a center case 14 through a bearing 13. The drive shaft 4 has an integrally formed flange 4*a* which is the planet carrier of a planetary gear reduction mechanism. A bearing 15 for rotatably supporting the front end of the motor shaft 2 is provided in a hollow cylindrical concave formed axially at the center of the rear end of the drive shaft 4.

The center case 14 covering the torque-transmission unit is interposed between the front housing 12 and the yoke 10 of the starter motor 3.

The pinion 6 is formed integrally with a spline tube 16 which engages a helical spline formed on the peripheral surface of the drive shaft 4. The pinion 6 is pressed forward along the helical spline of the drive shaft 4 through a lever 17, thus engaging a ring gear (not shown) of an engine. A middle point of the lever 17 is swingably supported by the front housing 12, with one end of the lever 17 engaging the peripheral surface of the spline tube 16 and the other end thereof engaging a movable rod 18 projecting from the front end of the magnet switch 7.

When the starter switch is turned on, an unshown coil incorporated in the magnet switch 7 is energized, thus generating a magnetic force. As a result, the magnet switch 7 attracts thereto an unshown plunger accommodated therein. Then, the contact of the starter motor 3 is closed, and the lever 17 is swung through the rod 18 so as to generate the force for pressing the pinion 6 forward.

The transmitting unit is composed of the planetary gear reduction mechanism and a one-way clutch.

The planetary gear reduction mechanism increases the output torque of the starter motor 3 by decreasing the rotational speed thereof. The planetary gear reduction mechanism has a sun gear 19 formed at the peripheral side of the motor shaft 2, three planetary gears 20 in engagement with the sun gear 19, an internal gear 21 in engagement with the three planetary gears 20 and the flange or planet carrier 4*a*.

The sun gear 19 rotates together with the motor shaft 2, thus transmitting the rotation of the motor shaft 2 to the three planetary gears 20.

Each of the three planetary gears 20 is rotatably supported by each of pins 22 fixed to the planet carrier 4*a* through a bearing 23. The three planetary gears 20 rotate around the sun gear 19 in mesh with the sun gear 19 and the internal gear 21. Therefore, when the three planetary gears 20 rotate around the sun gear 19, the torque of the motor shaft 2 is transmitted to the planet carrier 4*a* therethrough and then transmitted to the drive shaft 4.

The internal gear 21 is positioned at the rear end of a cylindrical rotary member 24 extending in the axial direction thereof. That is, the rear end of the cylindrical rotary member 24 is formed as the internal gear 21.

The one-way clutch rotatably supports the internal gear 21 of the planetary gear reduction mechanism in only one direction (direction in which internal gear 21 rotated by the engine). The one-way clutch has a clutch outer member 25, a clutch inner member 26 and a spring 28 as shown in FIG. 2A.

The clutch outer member 25 is positioned at the front end of the cylindrical rotary member 24. That is, the front end of the cylindrical rotary member 24 is formed as the clutch outer member 25. As shown in FIG. 2A, the clutch outer member 25 has a plurality of U-shaped cam chambers 25*a* formed on its inner peripheral surface.

Figure 3A:
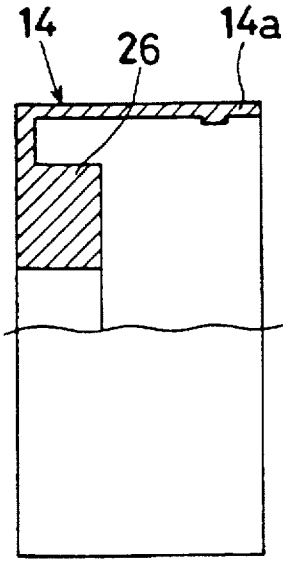
FIG. 3A is an elevational side view partly in section showing a center casing.
Figure 3B:
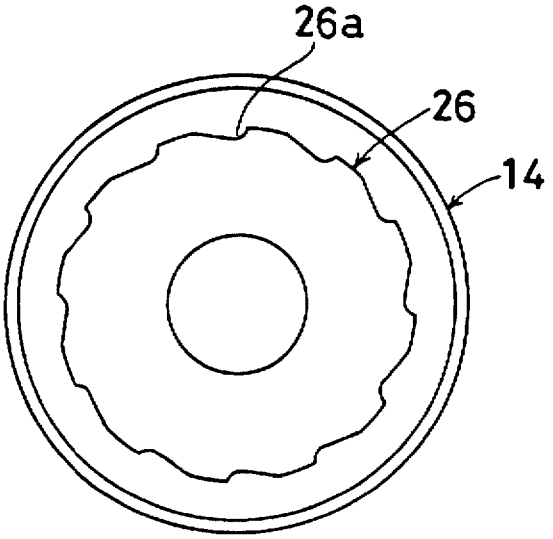
FIG. 3B is a front view showing the center casing shown in FIG. 3A.

As shown in FIG. 3A, the clutch inner member 26 is positioned along the inner peripheral surface of the clutch outer member 25 and integral with the inner side of the center case 14. As shown in FIG. 3B, a plurality of roller grooves 26a are formed on the peripheral surface of the clutch inner member 26.

Figure 2A:
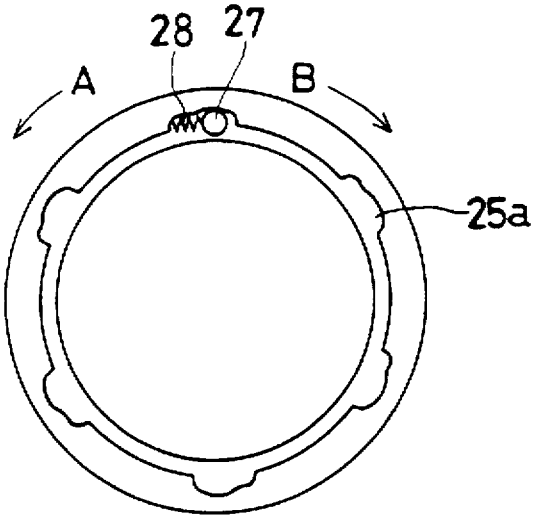
FIG. 2A is a front view showing a cylindrical rotary member.

Referring to FIG. 2A, the roller 27 and the spring 28 are accommodated in the cam chamber 25a in which the spring 28 presses the roller 27 toward a narrow portion of the cam chamber 25a so that the clutch outer member 25 can be locked to the clutch inner member 26 when the torque of the starter motor 3 is transmitted to the drive shaft 4, thus regulating the rotation of the clutch outer member 25 and the cylindrical rotary member 24.

Figure 2B:
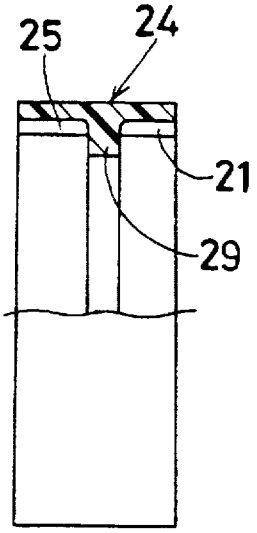
FIG. 2B is an elevational side view partly in section showing the cylindrical rotary member shown in FIG. 2A.

The cylindrical rotary member 24 is made of resin and positioned along the inner peripheral surface of the cylindrical wall 14a of the center case 14 so as to rotate with respect to the center case 14. As shown in FIG. 2B, the cylindrical rotary member 24 has a boss portion 29 formed integrally therewith to align the cylindrical rotary member 24, the internal gear 21, and the clutch outer member 25 coaxially with the drive shaft 4. The boss portion 29 of the cylindrical rotary member 24 is positioned between the internal gear 21 and the clutch outer member 25 around the peripheral surface of the planet carrier 4a so that the inner peripheral surface of the boss portion 29 is slidably carried by the peripheral surface of the planet carrier 4a.

The operation of the starter 1 of the first embodiment is described below.

When the starter switch is turned on, the coil of the magnet switch 7 is energized. As a result, the contact of the starter motor 3 is closed. Then, the armature rotor 8 is energized, and a torque is generated thereon. Consequently, the sun gear 19 rotates together with the motor shaft 2, thus driving the three planetary gears 20. At this time, the internal gear 21 in mesh with the planetary gears 20 receives the torque of the motor shaft 2 through the three planetary gears 20, the torque is applied to the internal gear 21 in a direction A shown in FIG. 2A.

As a result of the application of the torque to the internal gear 21, the roller 27 in the cam chamber 25a is pressed by the spring 28. As a result, each roller 27 is moved to a narrower portion of the cam chamber 25a, thus engaging the roller groove 26a of the clutch inner member 26. Since the inner peripheral surface of the boss portion 29 is slidably carried by the peripheral surface of the planet carrier 4a, the cylindrical rotary member 24 is aligned coaxially with the drive shaft 4. Thus, the cylindrical rotary member 24 can be prevented from becoming radially eccentric with respect to the drive shaft 4.

As a result, the clutch outer member 25 is locked through the roller 27 to the stationary clutch inner member 26 integral with the center case 14. That is, the rotation of the clutch outer member 25 and the internal gear 21 are restrained. At this time, each of the three planetary gears 20 rotates on each pin 22 while they are rotating around the sun gear 19. Thus, the torque of the motor shaft 2 is transmitted to the planet carrier 4a through the three planetary gears 20, thus driving the drive shaft 4 at a reduced speed.

Due to the attraction force of the magnet switch 7, the pinion 6 integral with the spline tube 16 engaging the drive shaft 4 is pressed forward along the drive shaft 4 through the lever 17, thus engaging the ring gear and transmitting the torque of the starter motor 3 to the ring gear and the engine.

When the engine is started and rotates the drive shaft 4 at a high speed, the three planetary gears 20 are ratted in the reversed direction. When the motor shaft 2 receives the engine torque through the three planetary gears 20, the internal gear 21, the roller 27 in the cam chamber 25a of the clutch outer member 25 moves to the wider portion against the spring 28, thus unlocking the clutch outer member 25 from the clutch inner member 26. Therefore, the internal gear 21 is allowed to rotate idly. At this time, the boss portion 29 of the cylindrical rotary member 24 aligns the axis of the internal gear 21 with that of the drive shaft 4, thus surely allowing the internal gear 21 to rotate idly. As a result, the torque of the engine is not transmitted to the motor shaft 2 and, accordingly, the overrun of the armature rotor 8 can be prevented.

In the starter 1 of the first embodiment, since the inner peripheral surface of the boss portion 29 formed on the cylindrical rotary member 24 is slidably carried by the peripheral surface of the planet carrier 4a, the axis of the cylindrical rotary member 24 is aligned with that of the drive shaft 4. Thus, the internal gear 21 can be prevented from becoming eccentric when the starter motor is actuated. Accordingly, the clutch outer member 25 can uniformly press the roller 27 against the peripheral surface of the clutch inner member 26, and the torque of the armature rotor 8 can be reliably transmitted to the drive shaft 4.

When the pinion 6 is driven at a high speed by the engine, the internal gear 21 idles at a high speed with the inner peripheral surface of the boss portion 29 in contact with the peripheral surface of the planet carrier 4a. Thus, the internal gear 21 is allowed to idle reliably. In particular, when the internal gear 21 idles at a high speed, the number of rotations of the drive shaft 4 relative to that of the internal gear 21 is small, as described below. Thus, there is no need for the provision of a particular bearing between the boss portion 29 and the planet carrier 4a, so that the boss portion 29, namely, the cylindrical rotary member 24 can be made of an inexpensive material, for example, resin.

The number of rotations of the drive shaft 4 relative to that of the internal gear 21 is described below. Let it be supposed that the number of rotations of the drive shaft 4 is Na, the number of rotations of the internal gear 21 is Ni, the number of rotations of the starter motor 3 is Nb, the number of teeth of the sun gear 19 is Za, and the number of teeth of the internal gear 21 is Zb.

In this case, the number of rotations of the internal gear 21 is determined by using an equation 1 shown below:

[Equation 1]

$$Ni=Na-(Nb-Na)\times Za/Zb$$

Accordingly, the number of rotations of the drive shaft 4 relative to that of the internal gear 21 is determined by using an equation 1 shown below:

[Equation 2]

$$Na-Ni=(Nb-Na)\times Za/Zb$$

As apparent from the above, the number of rotations of the drive shaft 4 relative to that of the internal gear 21 is small as Za/Zb is small. That is, the number of rotations of the inner peripheral surface of the boss portion 29 relative to that of the peripheral surface of the planet carrier 4a is small.

In the first embodiment, the boss portion 29, which aligns the axis of the cylindrical rotary member 24 with that of the drive shaft 4, is located so that the front portion of the cylindrical rotary member 24 balances well with the rear portion thereof in the axial direction thereof. Therefore, when the cylindrical rotary member 24 idles at a high speed, the cylindrical rotary member 24 is prevented from inclining or gyrating.

In the first embodiment, the radial thickness of the boss portion 29 is greater than that of the internal gear 21 and that of the clutch outer member 25. Therefore, the cylindrical rotary member 24 has a sufficient rigidity to prevent deforming due to a load applied to the internal gear 21 and the clutch outer member 25 when the starter 1 is driven by the engine.

(Second Embodiment)

Figure 4:
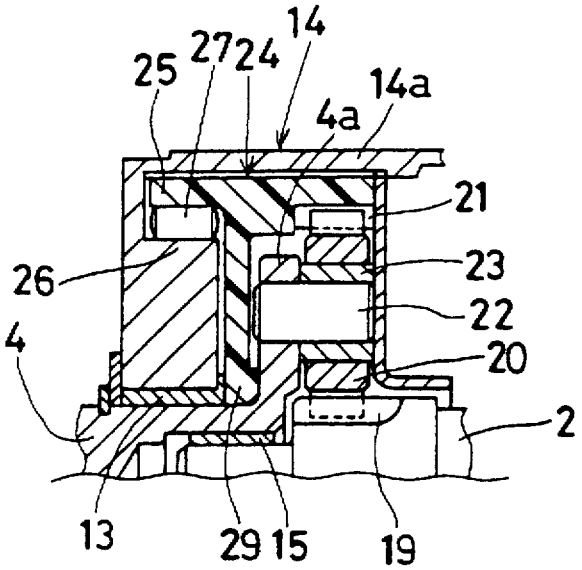
FIG. 4 is a cross-sectional side view showing main portions of a cylindrical rotary member according to a second embodiment of the present invention.
Figure 5:
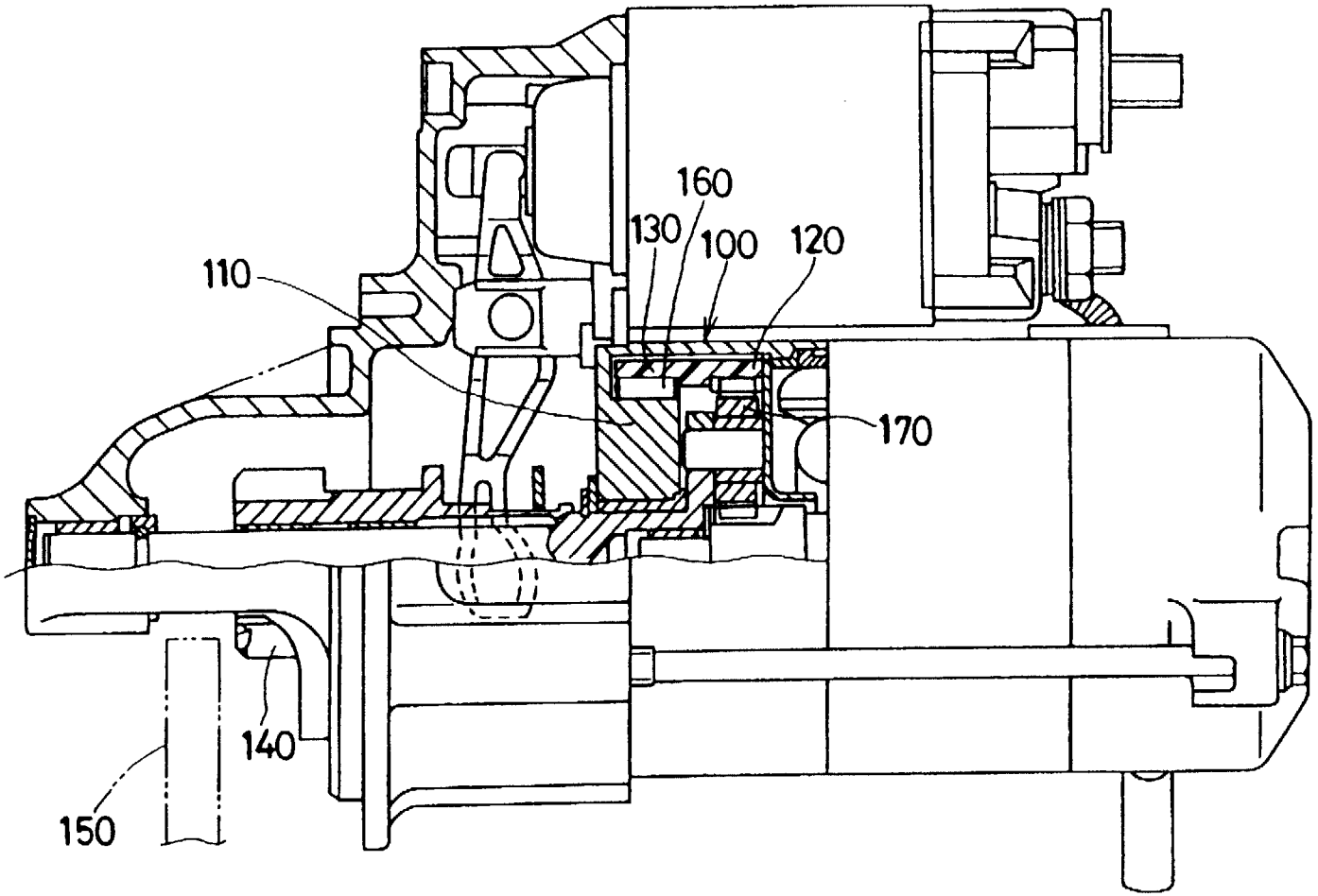
FIG. 5 PRIOR ART
FIG. 5 is a cross-sectional side view showing main portions of a starter disclosed in a prior application.

A second embodiment is described with reference to FIG. 4.

In the first embodiment, the axis of the cylindrical rotary member 24 is aligned with that of the drive shaft 4 by the sliding engagement of the inner peripheral surface of the boss portion 29 with the peripheral surface of the planet carrier 4*a*.

In order to accomplish the alignment of the cylindrical rotary member 24, the boss portion 29 of the second embodiment is separated from and located in front of the planet carrier 4*a* so that the boss portion 29 is carried by the drive shaft 4 directly. Therefore, the boss portion 29 of the second embodiment at its inner peripheral surface slides around the drive shaft at a speed lower than the boss portion 29 of the first embodiment, resulting in that the boss portion 29 is more wear-resistant than that of the first embodiment.

(Modification)

As a variation, the boss portion 29 can be carried on the peripheral surface of the planet carrier 4*a* or the peripheral surface of the drive shaft 4 through a bearing. The boss portion 29 can be disposed as a member separated from the cylindrical rotaty member 24. The boss portion 29 can be formed integrally with the flange portion or the planet carrier 4*a* to extend radially outward to engage an inner peripheral portion of the cylindrical rotary member 24. The clutch outer member can be formed in a portion of the cyllindrical rotary member 24 radially inner side of the internal gear 21.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A starter comprising:

a starter motor having an armature rotor and a motor shaft;

a drive shaft disposed coaxially with said motor shaft;

a planetary gear reduction mechanism, connected between said motor and said drive shaft, for changing rotational speed and torque of said motor shaft and transmitting changed speed and torque to said drive shaft, said mechanism including a sun gear formed around a periphery of the motor shaft, a plurality of planetary gears rotatable around the sun gear, with the planetary gears in mesh with the sun gear and an internal gear in engagement with said planetary gears;

a cylindrical rotary member having said internal gear at one end thereof, a clutch outer member at the other end thereof, and an integral boss portion to align said cylindrical rotary member coaxially with said drive shaft;

a center case having a clutch inner member disposed around said drive shaft; and a one-way clutch having said clutch outer member and said clutch inner member and a plurality of rollers accommodated between said clutch outer member and clutch inner member for restraining said the internal gear when said motor shaft rotates.

2. A starter according to claim 1, wherein said boss portion has an annular inner surface in slidable engagement with a cylindrical surface of said drive shaft.

3. A starter according to claim 2, wherein said drive shaft has a flange portion for supporting planetary gears rotatably and said cylindrical surface formed on a periphery thereof.

4. A starter according to claim 2, wherein said boss portion is disposed between said internal gear and said clutch outer member.

5. The starter according to claim 1, wherein said boss portion has radial thickness greater than radial thickness of the internal gear and the clutch outer member.

6. A starter comprising:

a starter motor having a rotor and a motor shaft;

a drive shaft having a pinion and being disposed coaxial with said motor shaft;

a planetary gear reduction mechanism including a sun gear formed around a periphery of said motor shaft, a plurality of planetary gears in engagement with said sun gear and an internal gear engaging the sun gear, said mechanism transmitting a torque of said starter motor to said drive shaft by reducing a rotational speed of said motor shaft when said internal gear is restrained from rotating;

a one-way clutch, having a clutch outer member provided coaxially with said internal gear, for restraining said internal gear from rotating when said torque is transmitted from said starter motor to said drive shaft; and a boss portion disposed between said internal gear and said clutch outer member and extending from said internal gear to said drive shaft for aligning said internal gear and said clutch outer member coaxially with said drive shaft.

7. A starter according to claim 6, wherein said drive shaft has a flange member which supports said planetary gear reduction mechanism rotatably on a side thereof and said boss portion slidably on a periphery thereof.

8. The starter according to claim 6 further comprising a magnet switch, wherein said internal gear, said clutch outer member and said boss portion are disposed integral with each other.

9. The starter according to claim 8, wherein said internal gear and said clutch outer member have cylindrical shapes.

* * * * *